United States Patent [19]

Takeuchi et al.

[11] 4,159,616

[45] Jul. 3, 1979

[54] METHOD FOR CONTROLLING AN OPEN-END SPINNING FRAME AND AN APPARATUS THEREFOR

[75] Inventors: Tatsuo Takeuchi, Chita; Kazuyoshi Ono, Chiryu; Naotake Furukawa, Chita; Katsuaki Sugiura, Okazaki; Osamu Suzuki, Obu; Takeshi Shimizu, Kariya, all of Japan

[73] Assignee: Kabushiki Kaisha, Toyoda Jidoshokki Seisakusho, Kariya, Japan

[21] Appl. No.: 870,687

[22] Filed: Jan. 19, 1978

[51] Int. Cl.[2] ..... D01H 13/18; D01H 1/12

[52] U.S. Cl. ..... 57/83; 57/58.95; 57/263

[58] Field of Search ..... 57/34 R, 58.89–58.95, 57/156, 78, 80, 81, 83, 263

[56] References Cited

U.S. PATENT DOCUMENTS

| | | | |
|---|---|---|---|
| 3,354,626 | 11/1967 | Cizek et al. | 57/83 X |
| 3,375,649 | 4/1968 | Bures et al. | 57/83 X |
| 3,541,774 | 11/1970 | Sterba et al. | 57/58.89 X |
| 3,879,926 | 4/1975 | Bartling et al. | 57/83 X |
| 3,988,879 | 11/1976 | Franzolini et al. | 57/34 R |
| 4,033,107 | 7/1977 | Sasayama et al. | 57/81 |

*Primary Examiner*—Charles Gorenstein

*Attorney, Agent, or Firm*—Sughrue, Rothwell, Mion, Zinn and Macpeak

[57] ABSTRACT

In a spinning frame the fiber feed device for each spinning unit is controlled by a separate clutch interposed between a common drive and each unit. The clutches are disengaged during initial start-up and the yarn ends from a previous operation are returned into the spinning chamber. The clutches are then engaged to feed fibers and the yarns are drawn out and taken up on a spool. A breakage detector is provided for each yarn which controls the clutch for each respective fiber feed.

3 Claims, 2 Drawing Figures

METHOD FOR CONTROLLING AN OPEN-END SPINNING FRAME AND AN APPARATUS THEREFOR

BACKGROUND OF THE INVENTION

The present invention relates to a method and apparatus for controlling an open-end spinning frame and, more particularly, to a method and apparatus for controlling a fiber feed machanism for starting and stopping of the spinning frame as well as for controlling to stop the same when there take place breakage of yarn.

An open-end spinning frame, in general, includes a plurality of spinning units. In each of these units, a bundle of fibers or a carded tape supplied from a fiber bundle supply device such as feed rollers is opened by the virtue of a opening device such as combining roller to provided discrete fibers, which are then fed into a gathering and twisting device of a rotary spinning chamber to form a yarn which, in turn, is drawn out of the aforesaid gathering and twisting device through a yarn guide pipe in the cooperation with a draw-off roller and a top roller rotating in contact therewith, the yarn being turned over the periphery of a bobbin held in pressure contact with a take-up roller, to thereby form a cheese.

In the prior open-end spinning frame of the type described, the driving system for fiber bundle feed mechanisms is constructed such that a driving power is in turn transmitted from a drive motor to a gear train, a feed roller driving shaft common for use with all the spinning units, a main electromagnetic clutch mounted on the aforesaid driving shaft, a common interlocking shaft, an auxiliary electromagnetic clutch in each spinning unit and a feed roller in each spinning unit, in this order. As a result, at the time of a starting operation of the spinning frame, the aforesaid main electromagnetic clutch is actuated by an electric control device and the like in the course of yarn ending operation so as to couple the interlocking shaft to the driving shaft whereby the feed roller in all the spinning units may simultaneously commenced to be rotated for starting the feeding of loosened fibers into rotary spinning chambers. When breakage of yarn takes place in any spinning unit during spinning operation, the auxiliary electromagnetic clutch in the spinning unit, in which yarn breakage took place is individually actuated to release only the feed roller in the aforesaid spinning unit from the engagement with the interlocking shaft, thereby interrupting fiber supply in the aforesaid unit, and when the operation of the spinning frame is to be terminated, the main electromagnetic clutch is switched off to release the interlocking shaft from the engagement with the driving shaft while an electromagnetic brake provided at an end of the interlocking shaft is actuated to brake the interlocking shaft, thereby simultaneously stopping all the feed rollers in respective spinning units.

The prior open-end spinning frame has, however, suffered from the disadvantages in that, because of its construction in which, upon starting and stopping the operation of the spinning frame, the main electromagnetic clutch provided between the driving shaft and the interlocking shaft is actuated and switched off to simultaneously commence and stop rotation of all the feed rollers in the spinning units together with the interlocking shaft, there tended to take place considerable twists or distorsion in the interlocking shaft extending over the length of the open-end spinning frame, particularly at the time where all the feed rollers are commenced to turn simultaneously by the actuation of the main electromagnetic clutch. This distortion of the interlocking shaft leads to the fact that, at the end of the interlocking shaft adjacent to the driving shaft, there results sufficiently synchronized starting of rotation between the interlocking shaft and driving shaft, while the other end of the interlock shaft remote from the driving shaft irregularly starts rotation in a delayed timing to the driving shaft, whereby the starting timing of the feed rollers located remote from the driving shaft becomes irregular, thereby preventing smooth operation of yarn ending. Further, a large inertia tends to act on the interlocking shaft due to the moment of rotation of the feed rollers which is produced when the main electromagnetic clutch is disengaged to simultaneously stop all the feed rollers together with the interlocking shaft. Such inertia, unless there is employed an electromagnetic brake adapted to effect braking of the interlocking shaft as in the prior art construction above described, will make it impossible to simultaneously stop all the feed rollers in respective spinning units in such a manner as to leave the end of yarn in respective yarn guide pipes, and thus the provision of such an electromagnetic brake leads to considerable complexity in the driving and controlling arrangement.

SUMMARY OF THE INVENTION

The present invention is directed to overcoming the above described disadvantages inherent in the prior construction and provides a novel method and apparatus for controlling an open-end spinning frame wherein an engaging and disengaging means such as electromagnetic clutch and the like provided in respective spinning units are rendered compatible to effect simultaneous starting and stopping of each fiber feed device upon starting and stopping of the spinning frame. On the one hand, stopping of any individual fiber feed device at the time of yarn breakage is made during the spinning operation without employing the conventional common main electromagnetic clutch having been used hitherto for simultaneously starting and stopping all the fiber feed devices in respective spinning units.

Generally, a clutch or a brake has a narrow limited range in controlling a torque or load and, for this reason, is used only in such instances wherein a variation of an applied torque or load is relatively small. If a clutch having a large capacity as compared with the torque or load applied is used, more time will be required for torque transmission. On the contrary, if a clutch of small capacity is employed, sliding of the clutch will take place, causing the failure of proper transmission of a torque. When a main electromagnetic clutch is employed in the proximity to a driving power source as in the prior art spinning frame, a large load corresponding to, say, a hundred spinning units, will be imposed on the clutch, whereby a considerable period of time is required for torque transmission. The feature of the invention lies in that the power transmission between fiber feed devices and the driving shaft is controlled for each spinning unit by means of electromagnetic clutches provided one for each of the spinning units, so that only a small load is applied to respective clutches, thereby ensuring rapid and positive transmission of a torque. Accordingly, yarn ending may greatly improved. In the prior art spinning frame in which the aforesaid main electromagnetic clutch is employed to control power transmission, the clutch is subjected to a large inertia or load when all the fiber feed devices are to be stopped, thereby requiring the provision of an electromagnetic brake. According to the invention, an inertia or load is reduced so that the fiber feed devices are capable of being stopped only by switching off individual electromagnetic clutches, without using an electromagnetic brake, whereby the construction of the driving and controlling mechanisms may be simplified, thus assuring the reduction in the manufacturing cost.

DESCRIPTION OF THE PREFERRED EMBODIMENT

Figure 1:
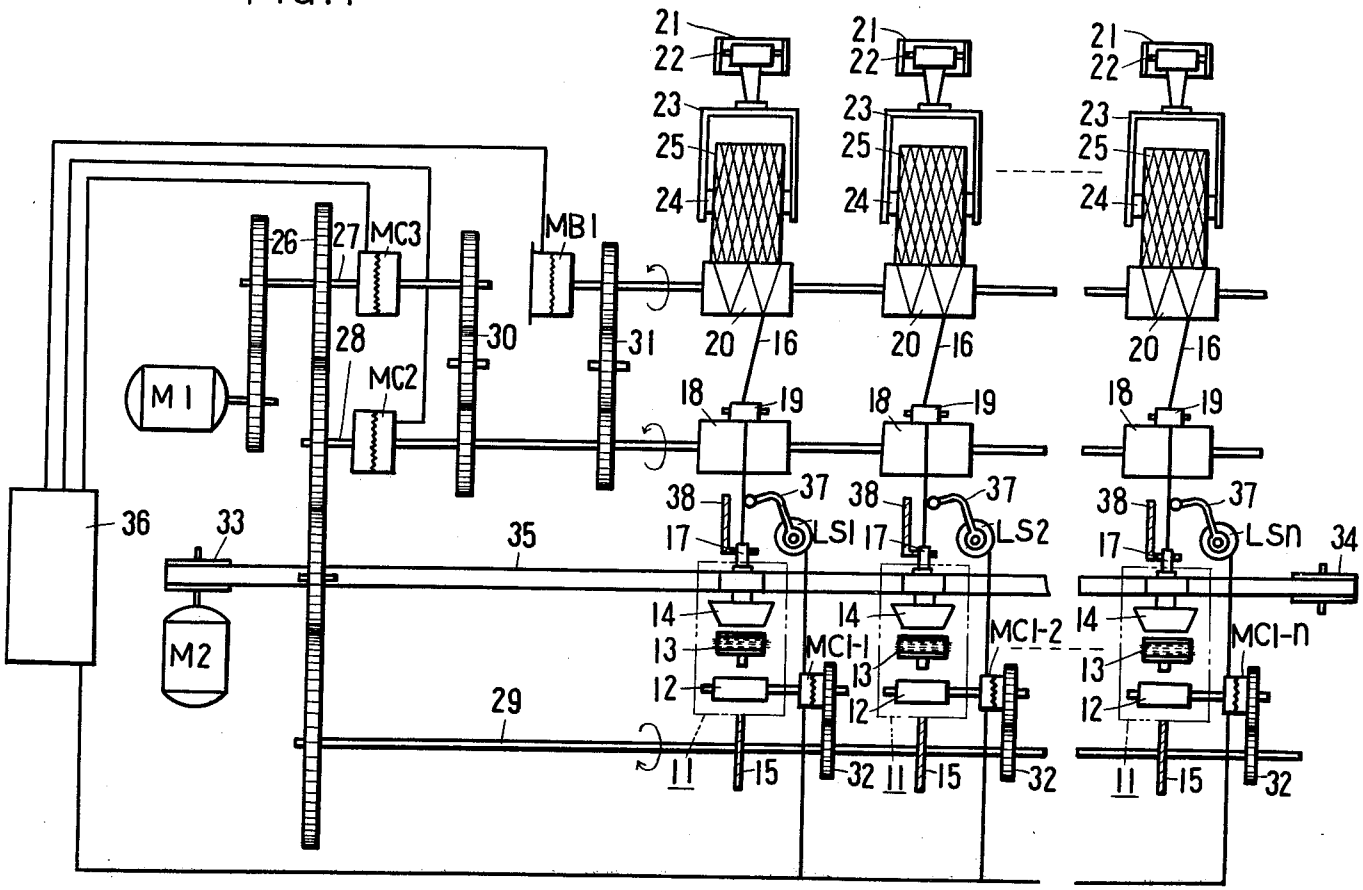
FIG. 1 is a diagrammatic illustration of the driving construction of an open-end spinning frame embodying the present invention.

The construction of an open-end spinning frame embodying this invention will now be described hereinafter in conjunction with the accompanying drawings. In this embodiment, the open-end spinning frame includes a plurality of spinning units which are arranged parallel as in the prior art. Adjacent the lower end of each of the spinning units, there is provided a spinning device 11 in which are arranged a feed roller 12, a combing roller 13 and a rotary spinning chamber 14. As the aforesaid rollers and spinning chamber rotate, a carded tape or bundle of fibers 15 supplied from the feed roller 12 is opened by the combing roller 13 and is gathered and twisted in the rotary spinning chamber into the form of a yarn 16 which is drawn outwards through a yarn guide pipe 17. Above the yarn guide pipe 17, there is provided a draw-off roller 18 which is positively driven by a driving means common to all the spinning units. A top roller 19 is provided for each of the draw-off rollers in pressure contact therewith. Thus, as the draw-off rollers 18 are turned, all the top rollers 19 are caused to rotate in contact therewith so that a yarn 16 fed from the yarn guide pipe 17 of each of spinning device 11 is held between the rollers and drawn upwardly.

Above the draw-off rollers 18 there are provided take-up rollers 20 which are positively driven by a common driving means. A fixed supporting frame 21 is mounted on each of spinning unit and rotatably supports a supporting shaft 22. A cradle arm 23 is fixed at its base to the aforesaid supporting shaft 22 and a bobbin 24 is rotatably supported between the legs of the cradle arm 23. Interposed between the aforesaid supporting shaft 22 and fixed support frame 21, there is provided a pressure means (not shown) for urging respective bobbins 24 against the periphery of the take-up roller 20. Accordingly, as the take-up rollers 20 rotated, all the bobbins 24 are turned simultaneously so that the yarns 16 being drawn by the draw-off rollers 18 and top rollers 19 are forced to pass the periphery of respective bobbins 24 to form a cheese 25, respectively.

Referring now to the construction of the driving device for driving respective spinning units, this embodiment incorporates two electric motors M1 and M2, the motor M1 being adapted to drive a forward or normally driving shaft 27 for the draw-off rollers 18 and take-up rollers 20, a reverse driving shaft 28 and a driving shaft 29 which extends over the length of the spinning frame for driving the feed rollers 12, by way of a gear train 26. Rotation of the aforesaid forward driving shaft 27 is transmitted to the draw-off rollers 18 by means of an electromagnetic clutch MC3 and a gear train 30, while the rotation of the reverse driving shaft 28 is adapted to be transmitted to the draw-off rollers 18 through an electromagnetic clutch MC2. The take-up rollers 20 are arranged to be driven by a gear train 31 in the same direction as the draw-off rollers 18.

Rotation of the driving shaft 29 for feed rollers 12 is adapted to be transmitted to the feed rollers 12 in respective spinning devices 11 via gear trains 32 provided one for each of the spinning unit and electromagnetic clutches MC1-1 through MC1-n which are adapted to be coupled to one another when they are disenergized. At the end of the shaft supporting the take-up rollers 20, there is provided an electromagnetic brake MB1 for braking the draw-off rollers 18 and take-up rollers 20 as the operation of a spinning frame is to be stopped. The other electric motor M2 drives an endless belt 35 trained around pulleys 33 and 34, the belt 35 being accommodated to drive the rotary spinning chambers 14 in respective spinning devices 11. All the motors M1 and M2, electromagnetic clutches MC1-1 through MC1-n, MC2 and MC3 and electromagnetic brake MB1 are adapted to be controlled by an electric control device 36 according to a predetermined timing program. The combing rollers 13 are also adapted to be driven by a belt-motor mechanism (not shown) in synchronism with the rotary spinning chambers 14.

With reference to a yarn breakage detecting device for detecting the breakage of yarn that occurs during the spinning operation in any spinning units, a detecting lever 37 is pivotally arranged between the yarn guide pipe 17 and drawn-off roller 18 in respective spinning units, the topmost end of the lever 37 being held in contact with a yarn 16. When there takes place a breakage of yarn in any spinning unit, the detecting lever 37 in the unit concerned will swing to hold the end of the yarn in cooperation with a fixed gripping means 38, and the lever, by doing so, closes corresponding one of detecting switches LS1 to LSn to produce a detecting signal.

Referring next to the circuit construction of the electric control device 36 in conjunction with FIGS. **2(*a*) and 2(*b*)**, the first through 14th circuits are formed between a pair of power source lines L—L.

In the first circuit, there are connected a starting pushbutton switch PB1 of the normally open type and an electromagnetic contactors MS for the aforesaid motors M1 and M2, a normally open, self-supporting contact MS-1 of the electromagnetic contactor MS being coupled in parallel with the starting pushbutton switch PB1. Normally open contacts MS-2 and MS-3 are interposed, respectively, in the 2nd and 11th circuits. In the 2nd circuit, there is connected a timer TRo for indicating the starting of the motors M1 and K2, the normally open contact TRO-1 of which is coupled to the 3rd circuit.

In parallel to the aforesaid timer TRO in the 2nd circuit, there are provided the 3rd through 6th circuits. In the 3rd circuit is connected a first relay CR1, while the normally open contacts CR1-1, CR1-2 and CR1-4 thereof are coupled, respectively, to the 4th, 5th and 12th circuits, with the normally closed contacts CR1-3 and CR1-5 thereof being connected, respectively, to the 9th and 14th circuits. In the 4th circuit is provided a counter A1 for setting a delayed starting timing of the feed roller 12 in accordance with the length of the yarn 16 returned at the time of starting operation of the spinning frame, the normally open contact A1-1 thereof being connected to the 6th circuit. In the 5th circuit, there is connected a counter A2 for setting the delayed timing of changing-over the reverse rotation of the draw-off rollers 18 and take-up rollers 20 into the forward rotation in accordance with the length of the yarn returned, the normally open contact A2-1 thereof being coupled to the 8th circuit. A second relay CR2 is connected in the 6th circuit and a self-supporting, normally open contact CR2-1 thereof is arranged in the 6th circuit in parallel to the aforesaid normally open contact A1-1. A normally open contact CR2-2 is coupled in the 7th circuit and normally closed contacts CR2-3 and CR2-4 are connected in the 9th and 11th circuits, respectively.

A timer TR1 for setting the timing of starting yarn breakage detecting on completion of yarn ending operation is provided in the 7th circuit, and a normally open contact TR1-1 thereof is connected to the 11th circuit. In the 8th circuit is connected a third relay CR3, a self-supporting, normally open contact CR3-1 of which is coupled parallelly with the aforesaid normally open contact A2-1, while normally oen contacts CR3-2, CR3-3 and CR3-5 are connected, respectively, to the 9th, 10th and 13th circuits, with normally closed contacts CR3-4 and CR3-6 being coupled to the 12th and 14th circuits, respectively. In the 9th circuit is provided a counter A3 for setting the timing of stopping the draw-off rollers 18 and take-up rollers 20 in a delayed relationship in accordance with the length of the yarn 16 which has been advanced after stopping of the feed rollers 12 as the operation of spinning frame is stopped. A normally closed contact A3-1 thereof is connected to the 8th circuit. In the 10th circuit are provided a stopping push-button switch PB2 of the normally open type and a fourth relay CR4, a self-supporting, normally open contact CR4-2 of the latter being connected in the 10th circuit in parallel to the aforesaid push-button switch PB2, whereas a normally open contact CR4-3 is coupled to the 11th circuit, with a normally closed contact CR4-1 connected to the 1st circuit.

In the 11th circuit, there are parallelly connected electromagnetic clutches MC1-1 through MC1-n which are interposed, respectively, between feed rollers 12 and the common driving shaft 29 of respective spinning units 11. Connected to the aforesaid electromagnetic clutches MC1-1 to MC1-n via a rectifier, there is provided a fiber feed control circuit consisting of the normally open contacts MS-3 of the electromagnetic contactor MS, the normally closed contact CR2-4 of the second relay CR2, and the normally open contact CR4-3 of the fourth relay CR4 which is parallel to the aforesaid contacts MS-3 and CR2-4. Connected also to the electromagnetic clutches MC1-1 to MC1-n, there is provided a yarn breakage detecting circuit including the normally open contact TR1-1 of the timer TR1 and normally open detecting switches LS1 to LSn of the respective yarn breakage detecting devices. An electromagnetic clutch MC2 for reversing the rotation of the draw-off rollers 18 and take-up roller 20 is connected in the 12th circuit, and an electromagnetic clutch MC3 is provided in the 13th circuit for forward rotation of the rollers 18 and 20. In the 14th circuit, there is connected an electromagnetic brake MB1 for braking the draw-off rollers 18 and take-up rollers 20.

The operations of the open-end spinning frame having the foregoing construction will now be described hereinafter.

Figure 2:
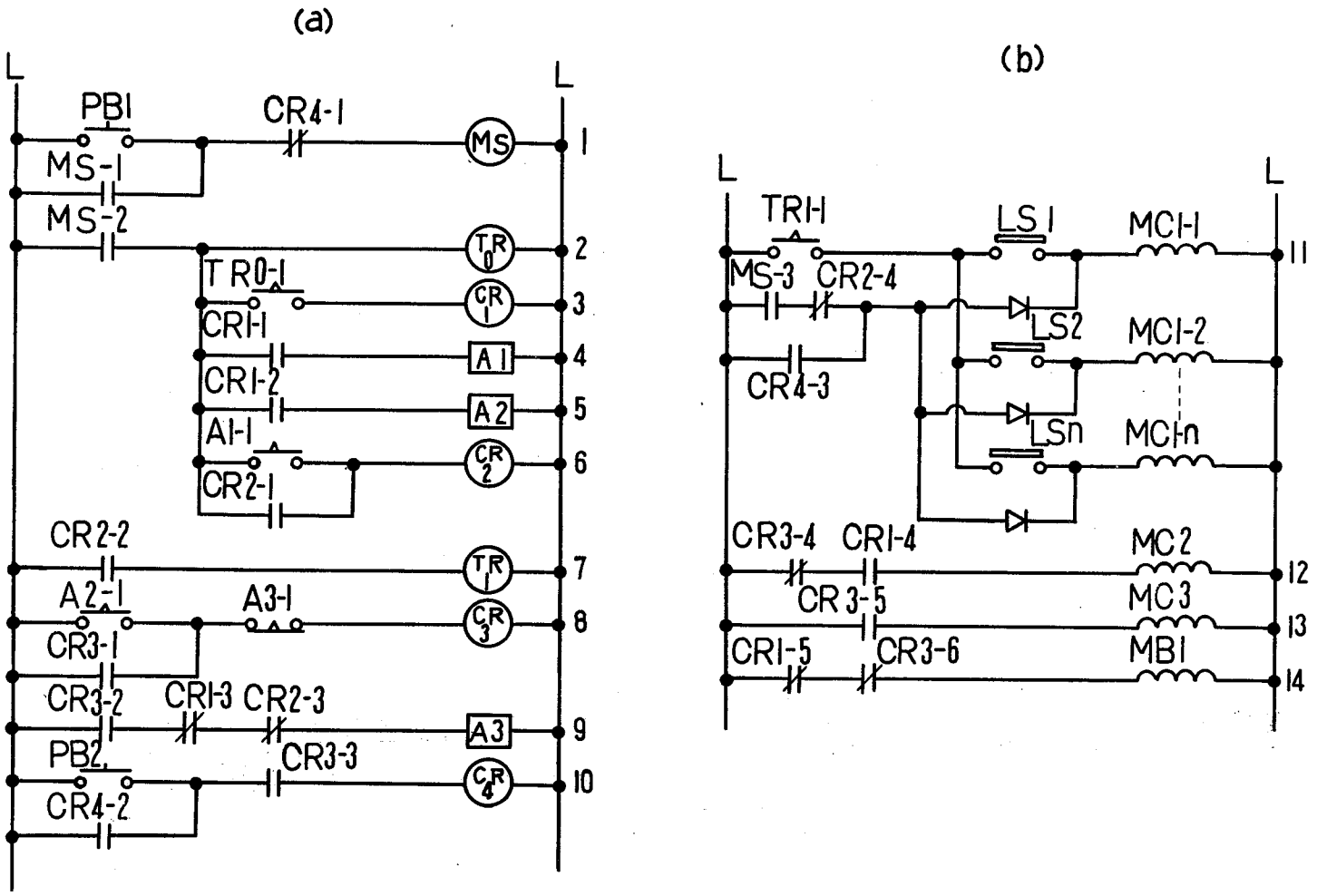
FIG. 2 is a diagram of a control circuit used therein.

To start the operation of the spinning frame, the starting push-button switch PB1 provided in the 1st circuit in FIG. 2(*a*) is closed whereupon the electromagnetic contactor MS is excited and the normally open contact MS-2 in the 2nd circuit is closed to set the timer TR0 and the normally open contact MS-3 in the 11th circuit is closed to actuate all the electromagnetic clutches MC1-1 through MC1-n simultaneously so that feed rollers 12 in respective spinning units 1 are retracted or released from the common driving shaft 29. Simultaneously therewith, the electric motors M1 and M2 illustrated in FIG. 1 are started to rotate due to excitation of the aforesaid electromagnetic contactor MS, to drive the forward driving shaft 27 for draw-off rollers 18 and take-up rollers 20, the reverse driving shaft 28, driving shaft 29 for feed rollers 12, combing rollers 13 in respective spinning devices 11 and rotary spinning chambers 14.

When the timer TRO in the 2nd circuit times-up as each of the aforesaid means attains to a desired speed of rotation, the normally open contact TRO-1 in the 3rd circuit is closed to energize the relay CR1 which closes the normally open contact CR1-1 in the 4th circuit to start counting in the counter A1 and closes the normally open contact CR1-2 in the 5th circuit to start counting in the counter A2. Together with the stimulation of the aforesaid first relay CR1, the normally closed contact CR1-5 in the 14th circuit is opened to switch off the electromagnetic brake MB1 adapted to brake the draw-off rollers 18 and take-up rollers 20 and the normally opened contact CR1-4 in the 12th circuit is closed to energize the electromagnetic clutch MC2 for the reverse rotation whereby the draw-off rollers 18 and take-up rollers 20 shown in FIG. 1 are coupled to the reverse driving shaft 28 and are turned in the reversed direction. Accordingly, an end of the yarn 16 being passed over the cheese 25 is moved back into the rotary spinning chamber 14 through the yarn guide pipe 17.

As a predetermined length of the yarn 16 is returned back as a result of reverse rotation of the draw-off rollers 18 and take-up rollers 20, the counter A1 in the 4th circuit counts-up in response to the length of returned yarn to close the normally open contact A1-1 in the 6th circuit whereupon the second relay CR2 is energized which closes the normally open contact CR2-2 in the 7th circuit to set the timer TR1 and opens the normally closed contact CR2-4 in the 11th circuit to disenergize simultaneously all the electromagnetic clutches MC1-1 through MC1-n. Thus, all the feed rollers 12 in spinning devices 11 are coupled, respectively, at a time to a common driving shaft 29 being rotated so that all the spinning units are started to rotate simultaneously thereby commencing supply of bundle of fibers 15, without creating fluctuation of starting timings that would occur due to distorsion of driving shaft system. Thereafter, the timer TR1 in the 7th circuit times-up to close the normally open contact TR1-1 in the 11th circuit so that the yarn breakage detecting circuit connected to the detecting switches LS1 to LSn is made ready for detection.

In this situation, as the counter A2 in the 5th circuit counts-up in accordance with the returned length of the yarn 16, the normally open contact A2-2 in the 8th circuit is closed to energize the third relay CR3 which, in turn, opens the normally closed contact CR3-4 in the 12th circuit to switch off the electromagnetic clutch MC2 and closes the normally opened contact CR3-5 in the 13th circuit to energize the electromagnetic clutch MC3, whereby the draw-off rollers 18 and take-up rollers 20 are brought into engagement with the forward driving shaft 27 and are changed over from the reverse to the forward rotation. Thus, a yarn 16 is drawn out of the rotary spinning chamber 14 through the yarn guide pipe 17 and, after yarn ending, is taken over by the normal spinning operations.

If the breakage of yarn takes place in any spinning unit while the yarn breakage detecting circuit is brought into operation by closing the normally open contact TR1-1 of the 11th circuit as above described, a detecting lever 37 in the spinning unit in which yarn breakage takes place swings to close the corresponding one of the detector switches LS1 to LSn in the 11th circuit so as to selectively energize corresponding one of the electromagnetic clutches MC1-1 to MC1-n. Accordingly, only the feed roller 12 in the spinning unit in which yarn breakage has taken place is released from engagement with the common driving shaft 29 to stop fiber supply.

In order to stop operations of the spinning frame, the stopping push-button switch PB2 in the 10th circuit as illustrated in FIG. 2(*a*) is closed to actuate the fourth relay CR4 whereupon the normally closed contact CR4-1 in the 1st circuit is opened to disable the electromagnetic contactor MS so that the electric motors M1 and M2 shown in FIG. 1 are allowed to stop after a short inertia-rotation. Accordingly, the top rollers 18, take-up rollers 20, feed rollers 12, combing rollers 13 and rotary spinning chambers also effect inertia rotation. Further, conjointly with the actuation of the fourth relay CR4, the normally open contact CR4-3 in the 11th circuit is closed to simultaneously actuate all the electromagnetic clutches MC1-1 through MC1-n so that the feed rollers in respective spinning devices 11 are released individually from the common driving shaft 29, the feed rollers being stopped after a lapse of short period of time due to their reduced mass, without requiring the provision of any specific control means.

As the electromagnetic contactor MS is disabled, the normally open contact MS-2 in the 2nd circuit is opened to disable both the first relay CR1 in the 3rd circuit and the second relay CR2 in the 6th circuit whereby the normally closed contacts CR1-3 and CR2-4 in the 9th circuit are closed so that the counter A3 start counting. Then, as a given length of yarn 16 is moved in accordance with the inertia rotation of the draw-off rollers 18 and take-up rollers 20 and the aforesaid counter A3 counts-up in proportion to the length of yarn moved, the normally closed contact A3-1 in the 8th circuit is opened to disable the third relay CR3. Upon disabling the relay CR3, the normally open contact CR3-3 in the 10th circuit is opened to disable the fourth relay CR4 and the normally open contact CR3-5 in the 13th circuit is opened to disenergize the electromagnetic clutch MC3, the normally closed contact CR3-6 being closed to excite the electromagnetic brake MB1. Thus, the draw-off rollers 18 and take-up rollers 20 as shown in FIG. 1 are released from the forward driving shaft 27 and are braked to stop instantaneously by the electromagnetic brake MB1.

While in the foregoing embodiment the electromagnetic clutches MC1-1 through MC1-n provided between the feed rollers 12 in respective spinning devices 11 and the common driving shaft 29 are constructed in such a manner as to be changed over into engagement upon disenergization thereof, it will be apparent that they may be constructed in a reversed relation so as to become engageable upon energization thereof. In that event, the fiber supply control circuit in the 11th circuit shown in FIG. 2(*b*) may be connected to the normally open contact of the second relay CR2 and the normally closed contact of the timer TR1, and the yarn breakage detecting circuit may be coupled to the normally open contact of the timer TR1 and the normally closed detecting switches LS1 to LSn.

What is claimed is:

1. In a method for controlling an open-end spinning frame which includes a plurality of spinning units and wherein discrete fibers are supplied by fiber feed means into rotary spinning chambers to form yarns which are drawn out of said spinning chambers by draw off rollers to form yarn packages due to the rotation of take-up rollers; the improvements in that: at the time of starting operations of said spinning frame, a common driving source is started in such a condition where all the engaging and disengaging means provided between said fiber feed means and said common driving source for driving same are disengaged; returning the ends of said yarns back into said rotary spinning chambers by reversely rotating said draw off rollers, engaging all the said engaging and disengaging means so as to bring said fiber feed means into operation, thereby starting feeding of fibers to said rotary spinning chambers, forwardly rotating said draw off rollers to draw said yarns out of said chambers; and thereafter detection of yarn breakage by way of yarn breakage detecting means is commenced in such a manner that upon occurence of yarn breakage in any spinning unit, said engaging and disengaging means in said any spinning unit may be disengaged individually from said common driving source.

2. A method of controlling an open-end spinning frame as claimed in claim 1, further comprising the step of, at the time of stopping operations of said spinning frame, changing over simultaneously all the said engaging and disengaging means into a disengaged condition so as to stop the feeding of fibers by said fiber feed means.

3. In an apparatus for controlling an open-end spinning frame which includes a plurality of spinning units and wherein discrete fibers are supplied by fiber feed means into rotary spinning chambers to form yarns which are drawn out of said spinning chambers to form yarn packages due to the rotation of take-up rollers; the improvements comprising:

electromagnetic clutches provided one for each spinning unit between fiber feed means of respective spinning units and a common driving source for driving said fiber feed means;

a fiber feed control circuit operative to hold all said electromagnetic clutches in a released or disengaged condition at the time of starting said common driving source and operative to simultaneously change-over all said electromagnetic clutches into an engaged condition in the course of yarn ending which is being effected by returning the end of yarn back to said rotary spinning chambers;

means for detecting occurrence of yarn breakage provided one for each of said spinning unit; and a yarn breakage detecting circuit operative to individually disengage any one of said electromagnetic clutches in said spinning units in response to a detecting signal from said detecting means, said yarn breakage detecting circuit being adapted to be change-over into an operative condition by said fiber feed control circuit after said electromagnetic clutches have been changed-over into an engaged condition.

* * * * *